US005847556A

United States Patent [19]

Kothandaraman et al.

[11] Patent Number: 5,847,556

[45] Date of Patent: Dec. 8, 1998

[54] PRECISION CURRENT SOURCE

[75] Inventors: Makeshwar Kothandaraman, Emmaus; Bijit Thakorbhai Patel, Breinigsville; David Arthur Rich, Whitehall, all of Pa.

[73] Assignee: Lucent Technologies Inc., Murray Hill, N.J.

[21] Appl. No.: 994,019

[22] Filed: Dec. 18, 1997

[51] Int. Cl.[6] ..... G05F 3/16

[52] U.S. Cl. ..... 323/315; 323/316

[58] Field of Search ..... 323/312, 313, 323/314, 315, 316; 327/530, 538, 539; 330/288

[56] References Cited

U.S. PATENT DOCUMENTS 5,512,816 4/1996 Lambert ..... 323/315

5,519,310 5/1996 Bartlett ..... 323/316

5,666,046 9/1997 Mietus ..... 323/313

*Primary Examiner*—Peter S. Wong

*Assistant Examiner*—Y. J. Han

[57] ABSTRACT

A current source includes a first current mirror and a second current mirror that share a common current path. The current in the common current path mirrors a current of a current reference connected to the first current mirror. A current in an output current path of the second current mirror mirrors the current of the common current path. A first feedback loop controls the current in the common current path and a second feedback loop matches a voltage of the common current path with an output voltage. The cooperation of the first and second feedback loops ensures that the output current replicates the current of the current reference even when an voltage of the current source is close to the supply voltage. Thus, the voltage swing of the current source output voltage is increased and a precision current source is provided even when the output voltage is close to the supply voltage.

23 Claims, 4 Drawing Sheets

PRECISION CURRENT SOURCE

BACKGROUND OF THE INVENTION

1. Field of Invention

This invention relates to precision current sources.

2. Description of Related Art

Current sources provide constant current over a wide range of voltages. When manufactured in an integrated circuit, current source designs take advantage of the ability to make devices with essentially identical characteristics and the ability to scale and adjust current capacity between matched devices by scaling relative sizes of the devices. While such "matching" devices provide an effective technique to match an output current to a reference current, such a match is not completely effective if there are operational differences between the matched devices. In addition, many current sources have cascode configurations which limits the output voltage range of the current mirror and the operation of the current mirror degrades when the output voltage is close to the supply voltage. In view of the above, new technology is needed to improve current source performance.

SUMMARY OF THE INVENTION

A current source includes a first current mirror and a second current mirror that share a common current path. The current in the common current path mirrors a current of a current reference connected to the first current mirror. A current in an output current path of the second current mirror mirrors the current of the common current path.

A first feedback loop controls the current in the common current path to ensure that it matches the current of the current reference. A second feedback loop ensures that voltages across matched devices of the second current mirror are also matched.

The cooperation of the first and second feedback loops ensures that the output current replicates the current of the current reference even when an voltage of the current source is close to the supply voltage. Thus, the voltage swing of the current source output voltage is increased and a precision current source is provided even when the output voltage is close to the supply voltage.

BRIEF DESCRIPTION OF THE DRAWINGS

The invention is described with reference to the following drawings wherein like numerals reference like elements, and wherein.

DETAILED DESCRIPTION OF PREFERRED EMBODIMENTS

Figure 1:
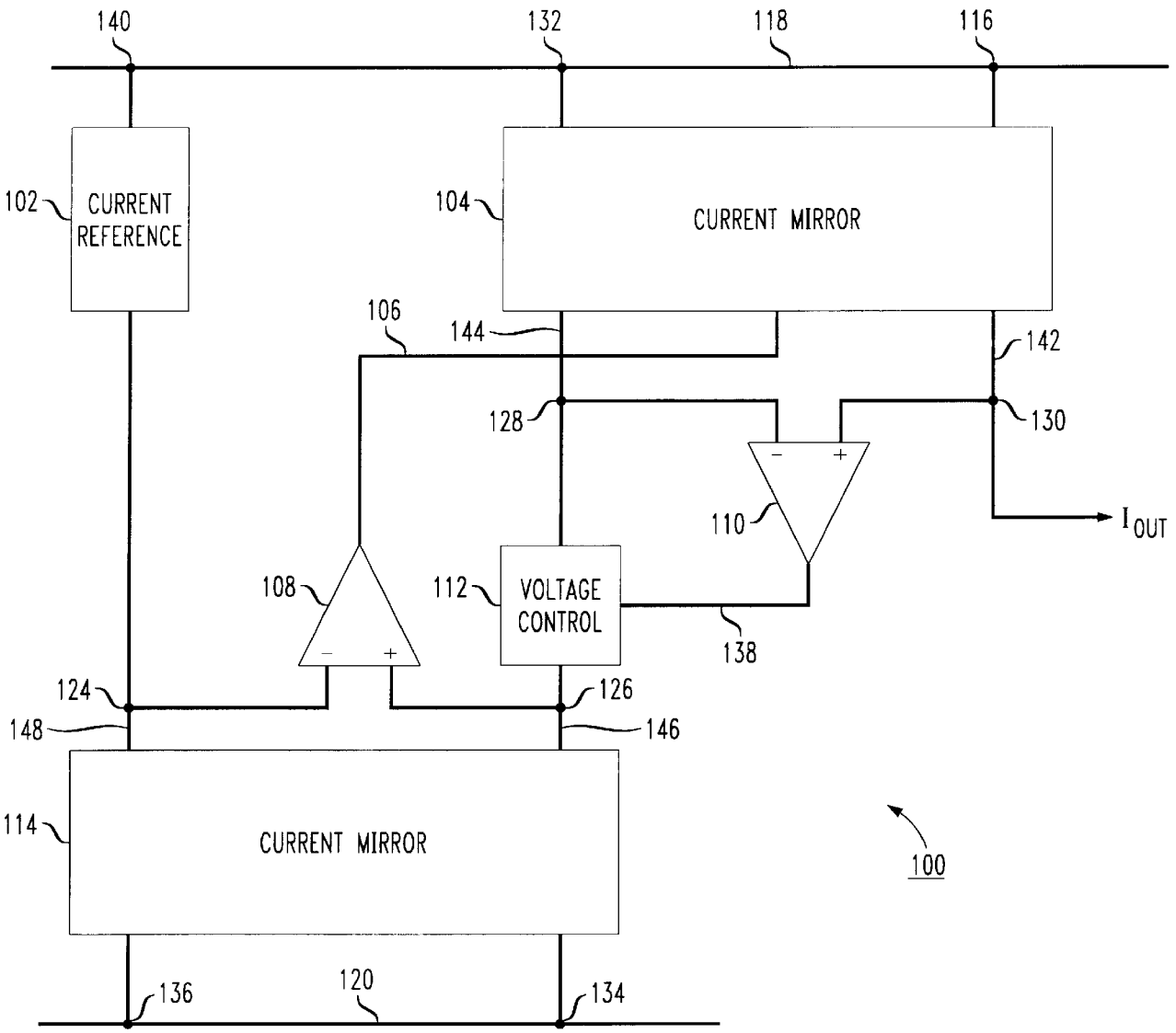
FIG. 1 shows a block diagram of a current source.

FIG. 1 is an exemplary preferred embodiment of a current source 100 operating between two supply lines 118 and 120. For the following discussion, the supply line 118 is a positive voltage supply line and the supply line 120 is a negative voltage supply line. Depending on the devices used for the current source 100, the polarities of the supply lines 118 and 120 may be reversed.

The current source 100 includes a first current mirror 114 and a second current mirror 104. The first current mirror 114 has a first current path 148 and a second current path 146. The first current path 148 is connected to a current reference 102 at node 124. The current reference 102 is connected to the power supply line 118 at node 140. The current path 148 is connected to the negative supply line 120 at node 136. The current path 146 is connected between a voltage control device 112 at node 126 and the negative supply line 120 at node 134. The current in the current path 148 is mirrored by the current in the current path 146.

The second current mirror 104 has a third current path 144 and a fourth current path 142. The current path 144 is connected between the positive supply line 118 and the voltage control device 112 at nodes 132 and 128, respectively. The fourth current path 142 is connected between the positive supply line 118 at node 116 and connected to an output node 130 of the current source 100. The current in the current path 142 mirrors the current in the current path 144.

The current source 100 also includes a first feedback loop with an amplifier 108 and a second feedback loop with an amplifier 110. An output of the amplifier 108 is connected to the second current mirror 104 and controls the current in the current path 144 of the second current mirror 104 which in turn affects the current in the current path 146 of the first current mirror 114 and the current 144 of the second current mirror 142. As the current in the current path 146 is changed, the voltage at the node 126 is also changed. The change in voltage at the node 126 is fed back to a positive input terminal of the amplifier 108. The negative input of the amplifier 108 is connected to the node 124. Thus, the amplifier 108 controls the current in the current paths 144 and 146 based on a voltage difference between the nodes 124 and 126.

The voltages of the nodes 124 and 126 are directly related to the currents in the current paths 148 and 146, respectively, as dictated by the devices in the respective current paths of the first current mirror 114. Thus, if the first current mirror 114 has a pair of matched devices, one in each current path 148 and 146, the first feedback loop ensures that the currents in the current paths 148 and 146 "matched" (i.e., are related by a fixed relationship depending on the physical sizes of the devices).

Because the first and the second current mirrors 114 and 104 share a common current path 146 and 144 and the output current in current path 142 mirrors the current in the current path 146, the output current mirrors the current in the current reference 102. However, the output voltage at the output node 130 depends on an unknown load. Thus, the output voltage is not predictable and directly affects the voltage across one of two matched devices in the current mirror 104 without similarly affecting a voltage across the other matched device of the current mirror 104.

In view of the above, the currents in the current paths 144 and 142 may be different from each other because of the voltage difference appearing across each of the matched devices. Thus, in order to ensure that the relationship between currents in the current paths 144 and 142 are matched (i.e., determined by the physical sizes alone), this voltage difference must be removed. This is the function of the second feedback loop.

The second feedback loop controls the voltage of the node 128 to match the voltage at the output node 130. An output of the amplifier 110 of the second feedback loop is connected to a control terminal of the voltage control device 112 through signal line 138. The voltage control device 112 controls the voltage at the node 128 which is connected to a negative terminal of the amplifier 110. A positive terminal of the amplifier 110 is connected to the output node 130 so that the amplifier 110 controls the voltage at the node 128 based on the voltage difference of the nodes 128 and 130.

The first feedback loop operates to ensure that the current in the current path 144 of the second current mirror 104 "matches" the current in the current path 148 of the first current mirror 114. The second feedback loop (together with the second current mirror 104) ensures that the current in the current path 142 "matches" the current in the current path 144. Thus, the output current in the current path 142 mirrors the current of the current reference 102 in the current path 148.

Figure 2:
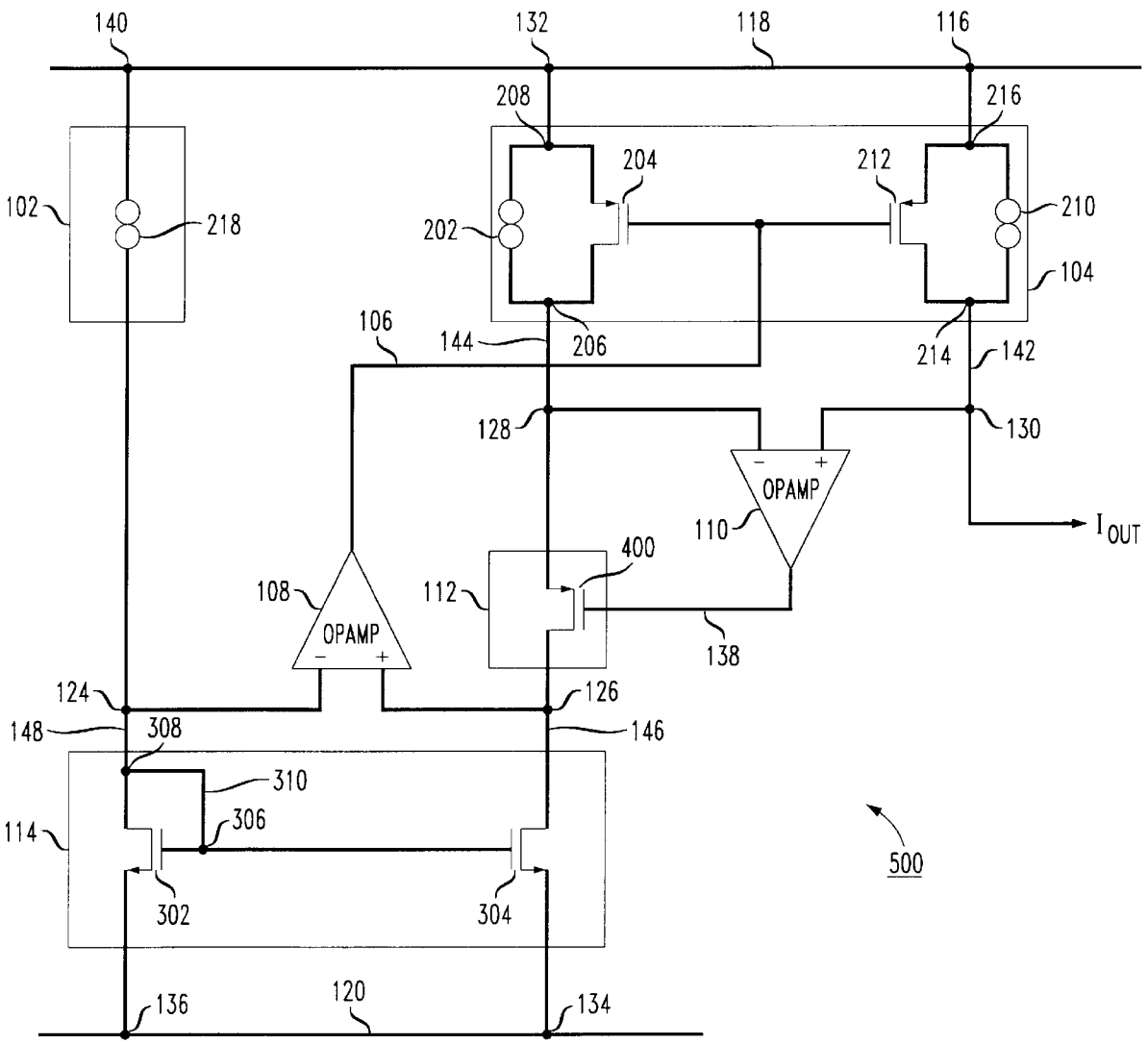
FIG. 2 shows a circuit diagram of an exemplary embodiment of the current source.

FIG. 2 shows an exemplary embodiment 500 of the current source 100 shown in FIG. 1. MOS transistors are used for this specific implementation. The current source 100 may be also implemented using bipolar transistors by replacing N-channel devices with NPN transistors and P-channel devices with PNP transistors, for example. Also, the amplifiers 108 and 110 are implemented using operational amplifiers (opamp). Other types of amplifiers may also be used. Simple current sources are shown but other current sources can be used.

In this embodiment, the current reference 102 is a current source 218 and the first current mirror 114 includes two N-channel MOS transistors 302 and 304. The MOS transistor 302 is configured in a diode configuration where the drain and gate of the transistor 302 are connected together at nodes 306 and 308 by signal line 310. The voltage control device 112 is a P-channel MOS transistor 400 where the source and drain of the transistor 400 are connected to the nodes 128 and 126, respectively. The gate of the MOS transistor 400 is connected to the output of the opamp 110 through the signal line 138.

The second current mirror 104 includes two current sources 202 and 210 and two P-channel MOS transistors 204 and 212. The current source 202 and transistor 204 are connected together at nodes 208 and 206 while the current source 210 and transistor 212 are connected together at nodes 214 and 216. The output of the opamp 108 is connected to the gates of the transistors 204 and 212 through signal line 106.

Figure 3:
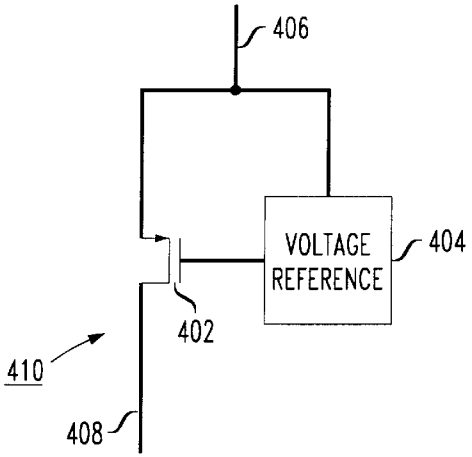
FIG. 3 shows an example of a current reference.

The current sources 218, 202 and 210 may be implemented by circuits such as a current source 410 shown in FIG. 3. The current source 410 has a P-channel MOS transistor 402 and a voltage reference 404 connected to the positive power supply through signal line 406. The voltage reference 404 sets the gate to source voltage of the transistor 402 so that the transistor 402 acts as a current source.

Figure 4:
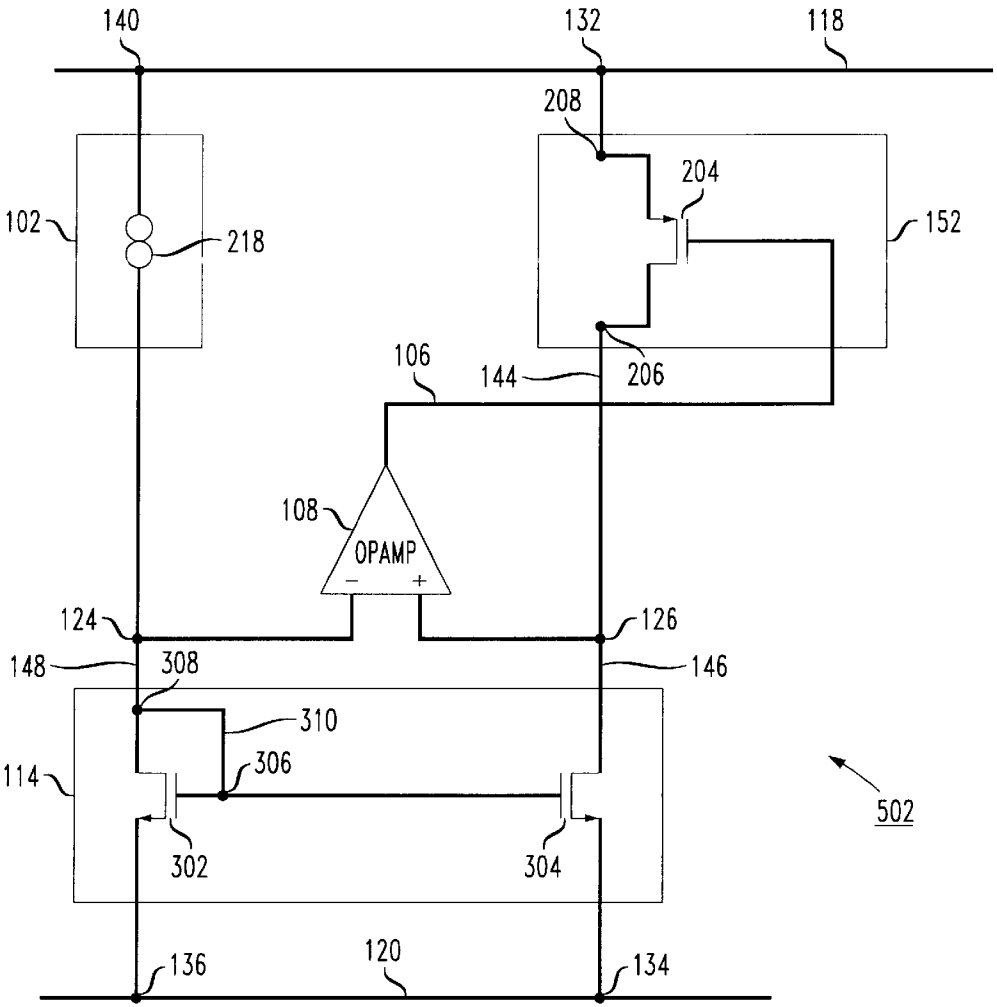
FIG. 4 shows a circuit diagram of a first feedback loop.

FIG. 4 shows a simplified view 502 of the first feedback loop of the current source 500. Components of the current reference 102 and the first current mirror 114 are identical to those components shown in FIG. 2. The second current mirror 104 is simplified to show only the transistor 204. The voltage control device 112 is removed altogether so that the functions of the first feedback loop may be clearly explained.

The transistor 302 of the first current mirror 114 is in saturation mode because it is diode connected and thus the gate to source voltage is equal to the drain to source voltage . The transistor 304 matches the transistor 302 so that if the voltage at node 126 matches the voltage at node 124, the current in the current path 146 also matches (i.e., a fixed relationship dictated by the physical size of the transistors 302 and 304) the current in the current path 148.

The first feedback loop ensures that the voltage of the nodes 124 and 126 match. The positive and negative input of the opamp 108 are connected to the nodes 126 and 124, respectively. The output of the opamp 108 is connected to the gate of the transistor 204 which regulates the current in the current paths 144 and 146. If the first feedback loop is not in equilibrium because the voltage at the node 126 is greater than the voltage at the node 124, the opamp 108 increases the gate voltage of the transistor 204 to return the first feedback loop to equilibrium. Because the transistor 204 is a P-channel MOS transistor, a higher gate voltage decreases the gate to source voltage which reduces the current in the transistor 204. Thus, as the gate voltage of the transistor 204 is increased, the current in the current path 144 and 146 is reduced, the voltage at the node 126 drops until it matches the voltage at the node 124, and the first feedback loop returns to equilibrium. The first feedback loop functions in a similar manner if the voltage at node 126 is less than the voltage at the node 124.

The gate to source voltage of the transistor 304 is set by the combination of the current source 218 and the diode connected transistor 302. Thus, the transistor 304 is in saturation mode similar to the transistor 302 and has a high output impedance, (i.e. the impedance at the node 126 looking into the transistor 304). This high impedance is a load for the transistor 204 which functions as a common source amplifier amplifying the output voltage of the opamp 108 and generating an output voltage at the node 126. Accordingly, the voltage at the node 126 is adjusted by the first feedback loop based on the voltage difference between the nodes 124 and 126.

The current in the current path 146 is the same as the current in the current path 144 because there are no other paths for the current to flow. The voltage at the node 126 changes until the current in current paths 144 and 146 the same because, even in saturation, the current flowing through the transistors 204 and 304 are related to the drain to source voltages . As the voltage of the node 126 drops the drain current of the transistor 204 increases and the drain current of the transistor 304 decreases. The opposite occurs if the voltage of the node 126 rises. Thus, the voltage at the node 126 is set to a value that causes the drain currents of the transistors 204 and 304 to be identical. By controlling the drain current of the transistor 204 through the gate voltage, the first feedback loop controls the current in current paths 144 and 146.

Thus, as the first feedback loop maintains the voltage at the nodes 126 and 124 to be substantially identical, and if the transistors 302 and 304 are matched, the current in the current path 144 is made identical to the current in the current path 146 which is in turn matched to the current in the current path 148. The operation of this first feedback loop is not changed if the current path 144 and current path 146 are separated by the voltage control unit 112 because the voltage control device 112 such as the transistor 400 merely passes the current from the current path 144 to the current path 146 without affecting the voltage at node 126.

Figure 5:
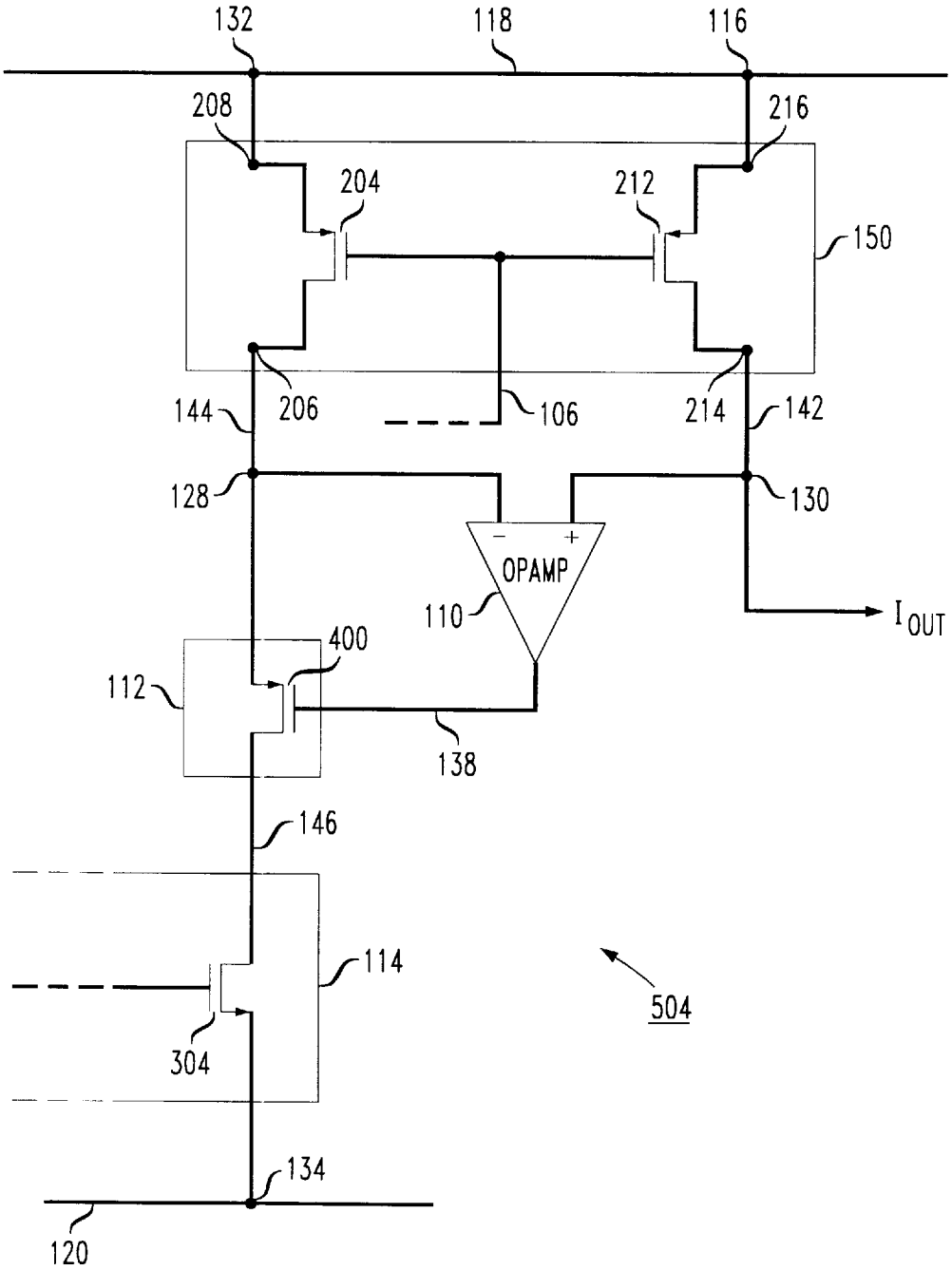
FIG. 5 shows a circuit diagram of a second feedback loop.

FIG. 5 shows a simplified view 504 of the second feedback loop of the current source 500 as shown in FIG. 2. The second current mirror 104 is simplified as current mirror 150 and does not include the current sources 202 and 210. In the second feedback loop, the positive and negative input terminals of the opamp 110 are connected to the nodes 130 and 128, respectively, and the output of the opamp 110 is connected to the gate of the P-channel transistor 400. The gate to source voltage of the transistor 400, is constant because the drain to source current flowing through the transistor 400 is constant. Thus, when the voltage of the node 130 is greater than the voltage at the node 128, the output voltage of the opamp 110 directly changes the voltage at the node 128 to cancel any voltage difference between the nodes 128 and 130. Thus, the second feedback loop maintains the voltage at the node 128 to be substantially equal to the voltage of the output node 130.

In view of the above, the current in the transistor 204 is matched to the current in the transistor 212 because the transistors 204 and 212 of the current mirror 150 are matched devices and all the terminals of both devices 204 and 212 are maintained at substantially the same voltages. This condition is maintained even when the transistors 204 and 212 are biased by the voltages of the nodes 128 and 130 into the triode region. Thus, the second feedback loop maintains the transistors 204 and 212 of the current mirror 150 in substantially identical conditions so that the currents in the current paths 144 and 142 are also substantially identical even when the voltage at node 130 is extremely close to the power supply line 118. The output impedance of the current source 100 is increased by a factor equal to the gain of the second feedback loop. Thus, current source performance is greatly improved over simple single transistor current sources, for example.

In addition, the current mirror 150 provides more head room (the voltage between the output voltage at the node 130 and the voltage of the power supply lines 118 and 120). Only a single transistor is included in each of the respective current paths 144 and 142 instead of two transistors used in the common cascode circuits, for example. Thus, the output voltage swing at node 130 is increased by using only a single transistor in each of the respective current paths.

Returning to FIG. 2, the current sources 202 and 210 reduces the gain of the first feedback loop. Because the transistor 204 only contributes to a percentage of the current in the current path 144, the gain is reduced correspondingly since every incremental change of the current in the transistor 204 contributes to less than 100% of the current in the current path 144. Because the current source 202 is set at a fixed value, the portion of the current in the current path 144 contributed by the current source 202 does not respond to the first feedback loop. This reduction of the loop gain improves the stability of the first feedback loop. The current source 210 matches the current source 202 thus permitting the accurate current mirroring by matching transistors 204 and 212.

While this invention has been described in conjunction with specific embodiments thereof, it is evident that many alternatives, modifications and variations will be apparent to those skilled in the art. For example, the current source 100 may be embodied as an integrated circuit, as a discrete circuit, or incorporated as a portion of an integrated circuit to provide an extremely accurate current source. Accordingly, the preferred embodiments as set forth herein are intended to be illustrative, not limiting. Various changes may be made without departing from the spirit and scope of the invention as defined in the following claims.

What is claimed is:

1. A current source outputting an output current through an output terminal, comprising:

a first current mirror having a first current path and a second current path;

a second current mirror having a third current path and a fourth current path, a current in the fourth current path being the output current; and a voltage control device connecting the second and the third current paths together, the voltage control device connected to the third current path at a first node and the second current path at a second node, wherein an output voltage of the output terminal is maintained to be substantially equal to a voltage of the first node by controlling the voltage control device.

2. The current source of claim 1 further comprising a current reference connected to the first current path of the first current mirror at a third node, wherein a voltage of the third node is maintained to be substantially equal to a voltage of the second node.

3. The current source of claim 2, further comprising:

a first feedback loop; and a second feedback loop, wherein the first feedback loop maintains the voltage of the third node to be substantially equal to the voltage of the second node and the second feedback loop maintains the output voltage of the output terminal to be substantially equal to a voltage of the first node.

4. The current source of claim 3, further comprising:

a first amplifier of the first feedback loop, wherein a positive input terminal of the first amplifier is connected to the second node and a negative input terminal is connected to the third node, an output of the first amplifier is connected to the second current mirror controlling the current in the third current path and;

a second amplifier of the second feedback loop, wherein a positive input terminal of the second amplifier is connected to the output terminal and a negative input terminal of the second amplifier is connected to the first node, an output of the second amplifier is connected to a control terminal of the voltage control device that controls the voltage of the first node.

5. The current source of claim 4, wherein the first and the second amplifiers are operational amplifiers.

6. The current source of claim 1, wherein the first current mirror comprises a first pair of matched transistor devices and the second current mirror comprises a second pair of matched transistors, a first transistor of the first pair being connected to the third node and a second transistor of the first pair being connected to the second node, a first transistor of the second pair being connected to the first node and a second transistor of the second pair being connected to the output terminal.

7. The current source of claim 6, wherein the first transistor of the first pair is connected in a diode configuration and control terminals of the first and the second transistors of the first and the second pairs of matched transistors are connected together.

8. The current source of claim 6, wherein the first and second the transistors of the first and the second pairs may be one of MOS transistors, bipolar transistors, metal semiconductor field effect transistors, junction field effect transistors and hetero-bipolar transistors.

9. The current source of claim 1, wherein the voltage control device is a transistor.

10. The current source of claim 9, wherein the transistor of the voltage control device is either a MOS transistor, bipolar transistor, metal semiconductor field effect transistor, junction field effect transistors, and hetero-bipolar transistor.

11. An integrated circuit that includes a current source outputting an output current through an output terminal, the current source comprising:

a first current mirror having a first current path and a second current path;

a second current mirror having a third current path and a fourth current path, a current in the fourth current path being the output current; and a voltage control device connecting the second and the third current paths together, the voltage control device connected to the third current path at a first node and the second current path at a second node, wherein an output voltage of the output terminal is maintained to be substantially equal to a voltage of the first node by controlling the voltage control device.

12. The integrated circuit of claim 11 further comprising a current reference connected to the first current path of the first current mirror at a third node, wherein a voltage of the third node is maintained to be substantially equal to a voltage of the second node.

13. The integrated circuit of claim 12, further comprising:

a first feedback loop; and a second feedback loop, wherein the first feedback loop maintains the voltage of the third node to be substantially equal to the voltage of the second node and the second feedback loop maintains the output voltage of the output terminal to be substantially equal to a voltage of the first node.

14. A method for operating a current source that outputs an output current through an output terminal, comprising:

matching currents in a first current path and a second current path of a first current mirror;

matching currents in a third current path and a fourth current path of a second current mirror, the second and the third current paths are connected having a same current;

maintaining a voltage of a first node in the third current path to be substantially the same as a voltage of the output terminal of the fourth current path by controlling the voltage of the first node in the third current path through a voltage control device.

15. The method claim 14 further comprising maintaining a voltage of the second node to be substantially the same as a voltage of the third node.

16. The method of claim 15, wherein a first feedback loop maintains the voltage of the third node to be substantially equal to the voltage of the second node and a second feedback loop maintains the output voltage of the output terminal to be substantially equal to the voltage of the first node.

17. The method of claim 16, further comprising:

controlling the current in the third current path using the first feedback loop, wherein a positive input terminal of a first amplifier of the first feedback loop is connected to the first node and a negative input terminal of the first amplifier is connected to the third node, an output of the first amplifier is connected to the second current mirror and;

controlling the voltage of the first node using a second feedback loop, wherein a positive input terminal of a second amplifier of the second feedback loop is connected to the output terminal and a negative input terminal of the second amplifier is connected to the first node, an output of the second amplifier is connected to a control terminal of the voltage control device to control the voltage of the first node.

18. The method of claim 17, wherein the first and the second amplifiers are operational amplifiers.

19. The method of claim 14, wherein the first current mirror comprises a first pair of matched transistor devices and the second current mirror comprises a second pair of matched transistors, a first transistor of the first pair being connected to the third node and a second transistor of the first pair being connected to the first node, a first transistor of the second pair being connected to the second node and a second transistor of the second pair being connected to the output terminal.

20. The method of claim 19, wherein the first transistor of the first pair is connected in a diode configuration and control terminals of the first and the second transistors of the first and the second pairs of matched transistors are connected together.

21. The method of claim 19, wherein the first and second the transistors of the first and the second pairs may be one of MOS transistors, bipolar transistors, metal semiconductor field effect transistors, junction field effect transistors and hetero-bipolar transistors.

22. The method of claim 14, wherein the voltage control device is a transistor.

23. The method of claim 21, wherein the transistor of the voltage control device is either a MOS transistor, bipolar transistor, metal semiconductor field effect transistor, junction field effect transistor, and hetero-bipolar transistor.

* * * * *